US005101633A

United States Patent [19]

Keller et al.

[11] Patent Number: 5,101,633

[45] Date of Patent: Apr. 7, 1992

[54] BURNER ARRANGEMENT INCLUDING COAXIAL SWIRLER WITH EXTENDED VANE PORTIONS

[75] Inventors: Jakob Keller, Dottikon; Thomas Sattelmayer, Mandach, both of Switzerland

[73] Assignee: Asea Brown Boveri Limited, Baden, Switzerland

[21] Appl. No.: 509,352

[22] Filed: Apr. 16, 1990

[30] Foreign Application Priority Data

Apr. 20, 1989 [CH] Switzerland ..... 1507/89

[51] Int. Cl.[5] ..... F23R 3/32; F02C 7/22

[52] U.S. Cl. ..... 60/737; 60/742; 60/748; 431/183; 239/405

[58] Field of Search ..... 60/748, 737, 738, 742, 60/39.091; 431/183, 184; 239/405, 403, 406

[56] References Cited

U.S. PATENT DOCUMENTS

| | | | |
|---|---|---|---|
| 2,669,296 | 2/1954 | Stillman et al. | 431/184 |
| 3,013,731 | 12/1961 | Carlisle | 239/403 |
| 3,076,497 | 2/1963 | Robb | 431/183 |
| 3,278,125 | 10/1966 | Doelling et al. | 239/405 |
| 3,409,231 | 11/1968 | Oehlerking | 239/406 |
| 3,713,588 | 1/1973 | Sharpe | 60/748 |
| 3,904,119 | 9/1975 | Watkins | 239/405 |
| 4,426,841 | 1/1984 | Cornelius et al. | 60/748 |
| 4,472,136 | 9/1984 | Lefebvre | 431/183 |
| 4,598,553 | 7/1986 | Saito et al. | 60/748 |
| 4,850,194 | 7/1989 | Fuglistaller et al. | 60/737 |
| 4,898,001 | 2/1990 | Kuroda et al. | 60/733 |

FOREIGN PATENT DOCUMENTS

| | | |
|---|---|---|
| 0169431 | 1/1986 | European Pat. Off. . |
| 0274630 | 7/1988 | European Pat. Off. . |
| 0276696 | 8/1988 | European Pat. Off. . |

*Primary Examiner*—Richard A. Bertsch
*Assistant Examiner*—Timothy S. Thorpe
*Attorney, Agent, or Firm*—Burns, Doane, Swecker & Mathis

[57] ABSTRACT

This burner arrangement has a main feed channel (2) for a fuel-air mixture, which channel discharges into a combustion chamber (1). A swirler, which is provided with swirl vanes (5), is penetrated by a burner lance (3), and into which exit openings for the fuel feed discharge, is provided in this main feed channel (2). The aim is to create a burner arrangement in which it is impossible for undesired instances of ignition of the fuel-air mixture to occur outside the combustion chamber (1). This is achieved in that the exit openings are constructed as nozzles (9) which discharge into a region between the swirl vanes (5). In this regard, at least one nozzle is provided between two neighboring swirl vanes (5).

5 Claims, 2 Drawing Sheets

BURNER ARRANGEMENT INCLUDING COAXIAL SWIRLER WITH EXTENDED VANE PORTIONS

BACKGROUND OF THE INVENTION

1. Field of the Invention

The invention proceeds from a burner arrangement having a main feed channel for a fuel-air mixture, said channel discharging into a combustion chamber. A swirler that is penetrated by a burner lance and fitted with swirl vanes is provided in the course of the main feed channel. Exit openings for the fuel feed discharge into the main feed channel.

2. Discussion of Background

A burner arrangement according to the preamble is known from a U.S. Pat. No. 4,850,194 to Fuglistaller et al. In this burner arrangement, fuel and air are mixed in a prechamber, and led into a combustion chamber through a swirler fitted with swirl vanes. A more intense mixing of fuel and air is achieved by virtue of the swirler, so that a perfect combustion process with a low degree of pollution can take place in the combustion chamber. However, it is possible for instances of ignition of the fuel-air mixture, which can have a negative effect on the stability of the burner arrangement, to occur as early as entry into the swirler.

SUMMARY OF THE INVENTION

Accordingly, one object of this invention is to provide a novel remedy in this respect. As exemplified in the claims, the invention achieves the object of creating a burner arrangement in which it is not possible for any undesired instances of ignition to occur outside the combustion chamber.

The advantages achieved by the invention are to be seen essentially in that emission values can be achieved which are equally as good as with a conventional premixing burner in conjunction with a substantially longer service life of the burner arrangement, and moreover its susceptibility to faults is lowered and its availability is enhanced. An especially advantageous outcome is that because of the elimination of the premixing chamber the axial extent of the burner arrangement can be kept comparatively small.

Further embodiments of the invention are the subject matter of the dependent claims.

The invention, its further development and the advantages which can thereby be attained are explained in more detail below with reference to the drawing, which represents only one embodiment.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawings.

DESCRIPTION OF THE PREFERRED EMBODIMENTS

Figure 1:
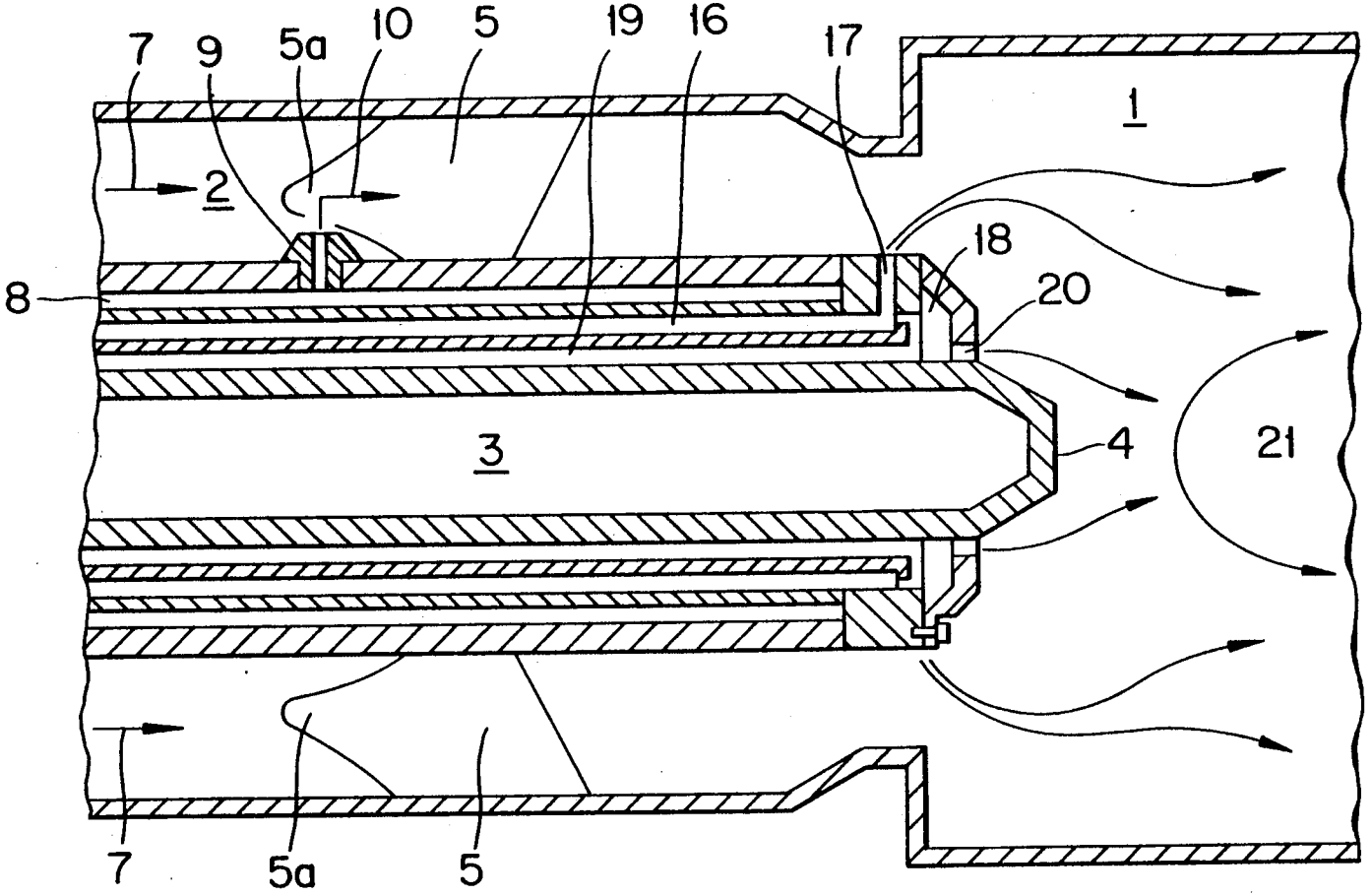
FIG. 1 shows a cross-sectional view through a burner arrangement one embodiment the invention.

Reference is now made to the only Figure. Discharging into a combustion chamber 1 is a main feed channel

2, which conducts a fuel-air mixture into the combustion chamber 1. Furthermore, the main feed channel 2 surrounds a burner lance 3, whose head 4 projects a little into the combustion chamber 1. The burner lance 3 penetrates a swirler having swirl vanes 5 curved in a known way, which is arranged rigidly in the main feed channel 2. Only the swirl vanes 5 of this swirler are represented, their mounting having been omitted for the sake of simplification. Likewise, the combustion chamber 1, the burner lance 3 and the main feed channel 2 are represented only in part and greatly simplified.

Arrows 7 specify the direction of inflow of the air required for the combustion into the main feed channel 2 and further into the combustion chamber 1. Fuel is fed in the burner lance 3 through a feed channel 8, and injected through nozzles 9 into the main feed channel 2, as is indicated by an arrow 10. The nozzles 9 are arranged such that mixing of the fuel with the air to form a combustible fuel-air mixture takes place between the swirl vanes 5. The swirl vanes 5 have noses 5*a*, which are drawn forward against the direction of airflow and channel the airflow. The nozzles 9 are distributed on the periphery of the burner lance 3 in such a way that at least one nozzle 9 is provided in each case between two swirl vanes 5 per interspace.

The drawing Figures will now be considered in more detail in order to explain the mode of operation. Injection of the fuel leads to an intense mixing with the air flowing in the main feed channel 2. Edges projecting into the flow of the fuel-air mixture can lead to local overheating and to undesired instances of ignition of the mixture outside the combustion chamber 1. If, now, the fuel is injected in such a way that it is still impossible for any combustible mixture to occur before the leading edges of the swirl vanes 5 seen in the direction of flow, a cause of undesired instances of ignition is thereby removed.

The noses 5*a*, which are drawn forward against the direction of airflow and channel the airflow, provide additional security. It is not possible for mixture to form, or consequently also for ignition to occur at the leading edge of the noses 5*a*. The flow is additionally accelerated in the region between the swirl vanes 5, because of the reduction in cross-section which they cause, so that no possibly occurring combustion could be stabilized there.

The mixing of fuel and air in the region of the swirl vanes 5 is sufficient to guarantee good combustion in the combustion chamber 1, so that only comparatively small amounts of pollutants leave the combustion chamber 1. Because of the elimination of the premixing chamber, the overall length of the burner arrangement is advantageously short, so that a comparatively compact arrangement results.

Such a burner arrangement can be provided for operation with gaseous, liquid or fluidized, powdered fuel. It is comparatively robust and of low susceptibility to wear, and guarantees a high operational availability.

As a rule, the fuel is fed through the burner lance 3. However, it is perfectly possible for the main amount of fuel also to be injected between the swirl vanes 5 through nozzles which are set into the outer wall of the main feed pipe 2. In this case, the burner lance 3 can be embodied with a smaller outer diameter.

Figure 2:
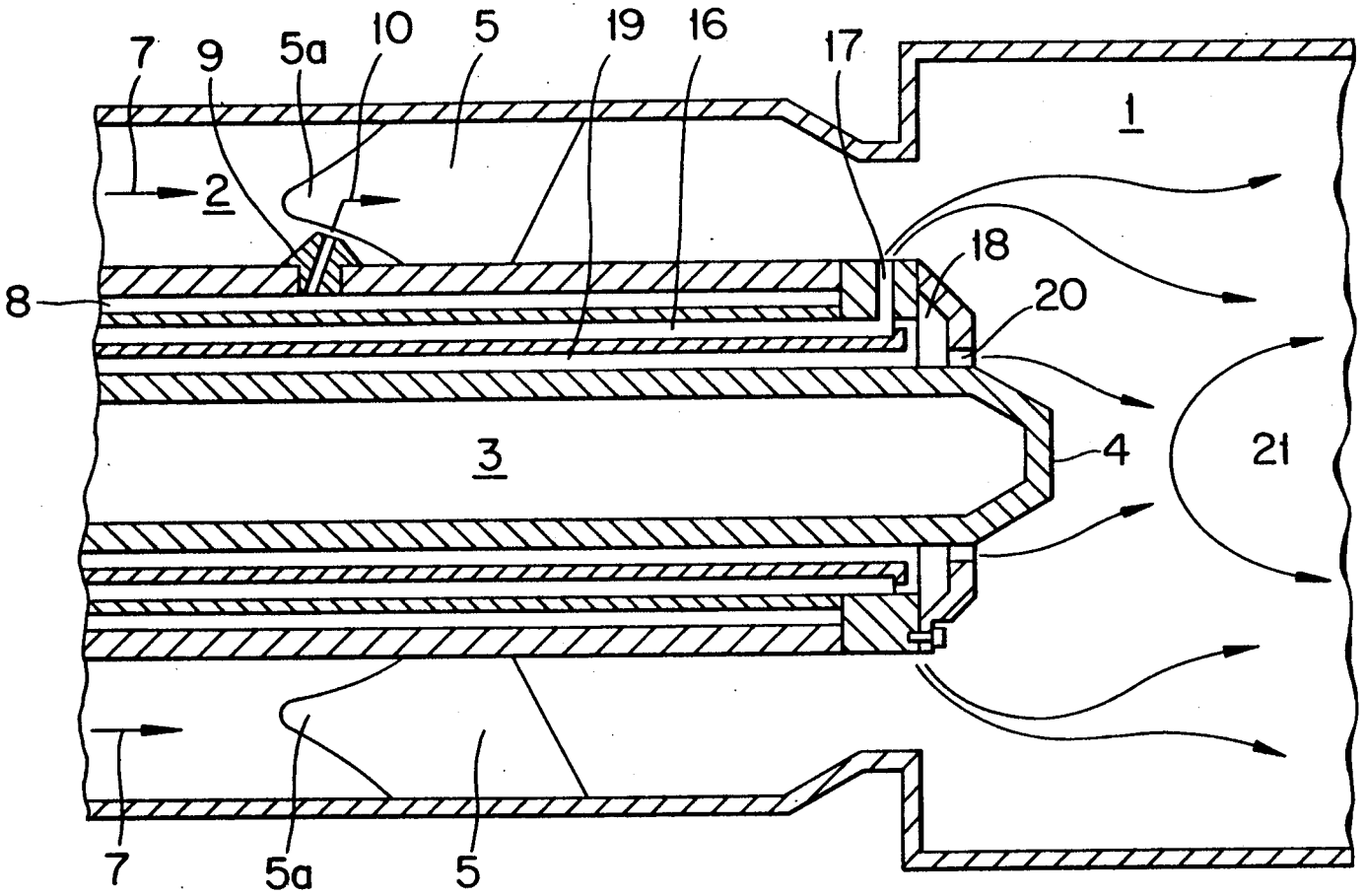
FIG. 2 shows a cross-sectional view through a burner arrangement according to a second embodiment of the invention.

It is advantageous for the nozzle 9 to have a longitudinal axis which is at a right angle to the longitudinal axis of the burner lance 3. However, it is also possible for the longitudinal axis of the nozzle 9 to be inclined to the combustion chamber 1 as shown in FIG. 2. In this case, angles in the range from 90° to approximately 45° to the longitudinal axis of the burner lance 3 should be provided. In this way, it is ensured that the fuel-air mixture cannot arise until between the swirl vanes 5.

On its own, without auxiliary burners, such a burner arrangement can be controlled only within very narrow limits. In order to extend the control range of the burner arrangement, and, in particular, to avoid complete extinction of the flame in the combustion chamber 1 when the burner arrangement is idling, the burner lance 3 has both a back-up burner and a keep-alive burner. The back-up burner is preferably constructed as a diffusion burner, and the keep-alive burner as a premixing burner. Preferably, use is made of a combination of the two concepts.

Provided in the burner lance 3 to form the back-up burner is a fuel channel 16 which has exit openings 17 leading radially outwards in the vicinity of the head 4 of the burner lance 3.

A premixing chamber 18, into which a channel for combustion air 19 and the abovementioned fuel channel 16 discharge and which has exit openings 20 oriented axially towards the combustion chamber 1, is provided in the head 4 of the burner lance 3 to form the keep-alive burner. The premixing chamber 18 is constructed as an annular chamber. The exit openings 20 can be distributed evenly over its circumference, or be constructed as an annular gap.

The fuel component in the fuel-air mixture emerging from the exit openings 20 of the premixing chamber 18 is adjusted such that the mixture is incombustible immediately in front of the head 4 of the burner lance 3. It cannot ignite until encountering an eddy return-flow zone 21, which is present in the combustion chamber 1 and slows it down. As a result, the flame supported by the keep-alive burner does not form until a safe distance from the head 4 of the burner lance 3, and so a flashback of the flame is also reliably prevented, especially in the premixing chamber 18.

The feed for the fuel and the combustion air for the back-up burner and the keep-alive burner is preferably constructed controllably. As a result, the possibility exists of turning down (partial load) or turning off (full load) these burners during normal operation of the burner arrangement, and of not putting them into operation until required, depending upon the operating condition of the burner arrangement.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A burner arrangement comprising:

a main feed channel for a fuel-air mixture;

a combustion chamber, said feed channel disposed to discharge into said combustion chamber;

a swirler being disposed at a location along said feed channel, said swirler having swirl vanes;

a burner lance extending along a longitudinal axis towards said combustion chamber, said lance extending through said swirler;

a plurality of nozzle means for directing a fuel feed in said lance into said main feed channel, said nozzle means being positioned along said main feed channel such that at least one nozzle means discharges fuel into a region between respective neighboring swirl vanes;

each of said swirl vanes having a nose-shaped extension extending in a direction opposite from said combustion chamber;

each of said plurality of nozzle means being positioned to discharge fuel in a region of said nose-shaped extension of each swirl vane.

2. A burner arrangement according to claim 1, wherein each of said plurality of nozzles means are inclined at an angle ranging between 45 degrees and 90 degrees relatives to said longitudinal axis.

3. A burner arrangement according to claim 1, further comprising auxiliary burner means for extending a control range of said burner arrangement.

4. A burner arrangement according to claim 1, wherein fuel of said fuel-air mixture is one of a gaseous, liquid and a fluidized powdered fuel.

5. A burner arrangement according to claim 1, wherein said plurality of nozzle means are positioned along said main fuel channel such that said fuel feed is discharged through an outer wall of said main feed channel.

* * * * *